US006536140B2

(12) United States Patent
Vaags et al.

(10) Patent No.: US 6,536,140 B2
(45) Date of Patent: Mar. 25, 2003

(54) SOIL SPREADING SCRAPER

(75) Inventors: Adolf Vaags, Dugald (CA); James J. Lundon, Crookston, MN (US)

(73) Assignee: Triple S-Ditcher, Inc., Cookston, MN (US)

( * ) Notice: Subject to any disclaimer, the term of this patent is extended or adjusted under 35 U.S.C. 154(b) by 0 days.

(21) Appl. No.: 10/083,858

(22) Filed: Feb. 26, 2002

(65) Prior Publication Data

US 2002/0124438 A1 Sep. 12, 2002

(30) Foreign Application Priority Data

Mar. 9, 2001 (CA) ..... 2340211

(51) Int. Cl.[7] ..... E02D 17/13; E02F 5/10
(52) U.S. Cl. ..... 37/94; 37/366; 172/149
(58) Field of Search ..... 37/94, 366, 367, 37/380, 381; 172/784, 817, 823, 149

(56) References Cited

U.S. PATENT DOCUMENTS 3,624,826 A 11/1971 Rogers
5,113,610 A 5/1992 Liebrecht, Jr.
5,237,761 A 8/1993 Nadeau et al.
6,226,903 B1 5/2001 Erickson

*Primary Examiner*—Christopher J. Novosad
(74) *Attorney, Agent, or Firm*—Stites & Harbison, PLLC; David W. Nagle, Jr.

(57) ABSTRACT

An apparatus for cutting a layer of soil and spreading the cut soil over adjacent ground comprises a disc having a rotational plane sloping backward and upward from a lower portion of the apparatus at an angle between 45 and 75 degrees above a horizontal plane. The disc surface includes an annular outer portion adjacent to the outer edge, and an inner portion. Spreading members are oriented upright on the disc surface. A blade is mounted ahead of and below the outer edge of the disc and is operative to cut a layer of soil. A pan extends from the blade rearward and over the outer portion of the disc surface. Soil flows over the pan onto the inner portion, but is prevented from flowing onto the outer portion of the disc. A kicker propels soil rearward and toward the center of the disc.

25 Claims, 3 Drawing Sheets

SOIL SPREADING SCRAPER

This invention is in the field of machines for moving soil and in particular such machines where the soil is scraped up by a scraping blade and spread with a rotating disc.

BACKGROUND

Machines for and moving soil are numerous and of many varieties. They are used in many varied situations where it is required to move soil for one reason or the other.

In some situations it is required to pick up soil at one location and transport it to another. In the case of road building for instance, the contour of the ground is changed to form a road by taking the soil from one location and placing it in another. Not only must the soil be removed from one location, it must also be placed in another specific location.

In many situations however, it is only desired to remove the soil from its current location, and the location it is moved to is not critical. Often it is desired to simply spread the removed soil so that it does not interfere with future operations on the land. An example is where ditches are made to drain standing water from ponds on agricultural lands.

Conventional soil moving machines include scrapers and loaders, where a generally horizontal blade is moved at a shallow depth along the ground, lifting soil and moving same into a bucket where it remains until dumped. Scrapers may incorporate a chain elevator to assist in moving the soil into the bucket. Trenchers or ditchers generally move the soil from the trench and pile it beside the trench, although ditchers are also known which spread the soil that is removed. Such soil-spreading ditchers are disclosed in U.S. Pat. Nos. 3,624,826 to Rogers, U.S. Pat. No. 5,237,761 to Nadeau et al., U.S. Pat. No. 5,113,610 to Liebrecht et al., and U.S. Pat. No. 6,226,903B1 to Erickson.

The ditch cleaning apparatus of Rogers comprises a disc rotating in a substantially vertical plane. The apparatus rides on skids and is designed essentially to clean existing ditches. The ditcher of Nadeau et al. similarly comprises a disc rotating in a substantially vertical plane and having rippers ahead of the disc. The disc of Nadeau et al. disperses the soil loosened by the rippers. The apparatuses of Rogers and Nadeau et al. leave a ditch with a rounded bottom having a radius substantially equal to the radius of the disc.

The apparatus of Liebrecht et al. uses a spinning disc to both cut and spread the soil. The plane of the disc is oriented at a shallow angle of 15–30 degrees above horizontal, and a shallow angle to one side of 10–30 degrees.

The apparatus of Erickson uses a blade to scrape up soil and deposit it onto a spinning disc that has a plane oriented at less than 45 degrees above horizontal. The blade raises the soil onto a pan and then the soil passes over the pan and onto the disc which has an edge that is juxtaposed to a semi-circular cut-out in the pan. The disc rotates at a relatively shallow angle so that the soil is not raised very much before it is thrown off the disc. A beater may be provided above the pan to push the raised soil down onto the disc as it leaves the pan.

In the Erickson apparatus, because the disc edge is juxtaposed to the cut-out in the pan, the soil falls from the pan onto the very outside of the disc, placing maximum torque on the drive train. Dropping the soil onto a mid-point of the disc removed from the edge would reduce the power requirement of the apparatus. Then as the disc rotated and carried the soil to the discharge, centrifugal force would cause the soil to slide to the edge and off the disc and be spread over the adjacent ground. Dropping soil on an inner portion of the disc also would improve the spread. Soil dropped on the edge of the disc has only a small distance to travel before being thrown off the disc, so that the soil will be spread predominantly on one side. Soil that falls on an inner portion of the disc must first travel to the edge of the disc before being expelled at some point further along in the rotational direction.

The Erickson apparatus also does not allow soil to be thrown out of deeper ditches because the disc angle is shallow, less than 45 degrees above horizontal. A predominant object of the Erickson apparatus is to operate with a reduced power requirement. The shallow angle does reduce the power requirement since the soil is not lifted as high as would be the case with a steeper angle above 45 degrees. However by depositing the cut soil on a mid-point of the disc, sufficient power could be saved such that the angle could be increased, allowing the apparatus to work in a wider variety of ditch depths.

SUMMARY OF THE INVENTION

It is an object of the present invention to provide a scraper apparatus for removing a layer of soil and spreading the removed soil across the ground adjacent to the apparatus. It is a further object of the invention to provide such an apparatus with an improved spread pattern. It is a further object of the invention to provide such an apparatus that can spread soil out of deeper ditches than prior art machines.

It is a further object of the invention to provide such an apparatus where cut soil falls onto an inner portion of a disc and is thrown to the edge of the disc by centrifugal force, thereby improving the spread and reducing the power requirements of the disc and allowing the disc to be oriented at a higher angle to allow soil to be thrown out of deeper ditches.

The invention provides, in one aspect, an apparatus adapted for travel along the ground in an operating travel direction for cutting a layer of soil and spreading the cut soil over the ground adjacent to the apparatus. The apparatus comprises a disc rotatably mounted on the apparatus, the disc having a rotational plane sloping backward and upward from a lower portion of the apparatus at an angle between 45 and 75 degrees above a horizontal plane. The disc has a top surface that includes an annular outer portion adjacent to an outer edge of the disc, and an inner portion, and a plurality of spreading, members are oriented upright on the top surface of the disc. A blade is mounted on a lower front portion of the apparatus ahead of and below the outer edge of the disc and operative to cut a layer of soil. A pan extends from the blade rearward and over the outer portion of the top surface of the disc such that soil cut by the blade can flow over the pan and onto the inner portion of the top surface of the disc, but is substantially prevented from flowing onto the outer portion of the top surface of the disc. A kicker is rotatably mounted above the blade about a kicker axis transverse to the operating travel direction. The kicker is operative to propel soil cut by the blade in a direction rearward and toward a center of the apparatus and a drive is operative to rotate the disc and the kicker.

The invention provides, in a second aspect, an apparatus for cutting a layer of soil and spreading the cut soil over the ground adjacent to the apparatus. The apparatus comprises a frame adapted for travel along the ground in an operating travel direction and a blade mounted on a lower front portion of the frame and operative to cut a layer of soil. A disc is rotatably mounted on the frame behind the blade, the disc having a rotational plane sloping backward and upward from a lower portion of the frame at an angle between 45 and 75 degrees above a horizontal plane. A plurality of spreading members are oriented upright on a top surface of the disc. A pan is mounted on the frame and extends from the blade rearward to a location above the top surface of the disc removed from an outer edge of the disc such that soil cut by the blade can flow over the pan and onto the top surface of the disc, but is substantially prevented from falling onto an outer portion of the top surface of the disc that is in proximity to an outer edge of the disc. A kicker is rotatably mounted on the frame above the blade about a kicker axis transverse to the operating travel direction and the kicker is operative to propel soil cut by the blade in a direction rearward and toward a center of the apparatus. A drive is operative to rotate the disc and the kicker.

The apparatus uses a backward sloping disc to spread soil oriented at a higher angle than prior art machines, enabling it to throw soil out of deeper ditches while still cutting a essentially flat bottom ditch, rather than the arced bottom ditch of vertical disc machines. The plate and kicker are operative to direct more soil to inner portions of the disc than is possible with prior art machines. Directing soil to the inner disc portions reduces power requirements and improves spread, since soil nearer the center must move farther before reaching the edge and being expelled from the disc surface. This inner deposited soil thus exits the disc at a later point in the disc rotation than that nearer the edge.

The apparatus can also include a pendulum to indicate slope of the blade from side to side to an operator, and controls to adjust the slope of the blade.

DESCRIPTION OF THE DRAWINGS

While the invention is claimed in the concluding portions hereof, preferred embodiments are provided in the accompanying detailed description which may be best understood in conjunction with the accompanying diagrams where like parts in each of the several diagrams are labeled with like numbers, and where:

DETAILED DESCRIPTION OF THE ILLUSTRATED EMBODIMENTS

Figure 1:
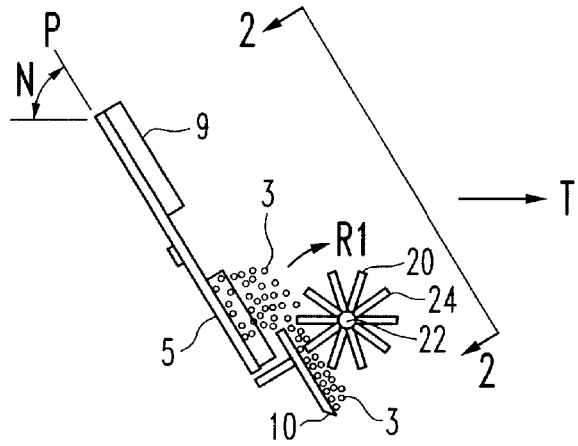
FIG. 1 is a schematic side view of an apparatus embodying the invention.
Figure 2:
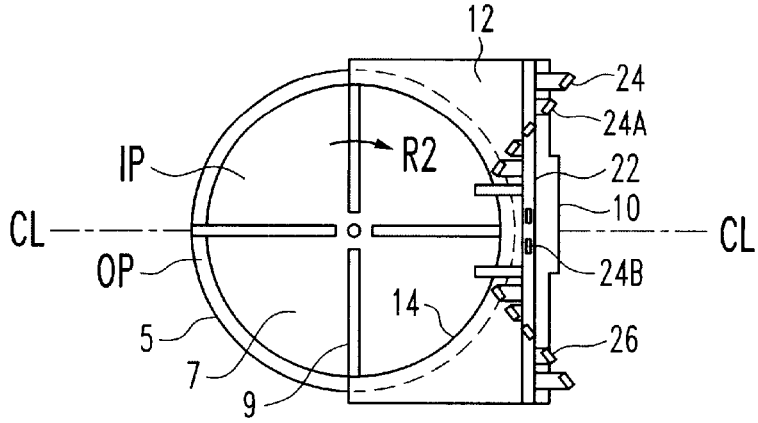
FIG. 2 is a schematic view of the apparatus of FIG. 1 in direction 2—2 as indicated in FIG. 1.
Figure 3:
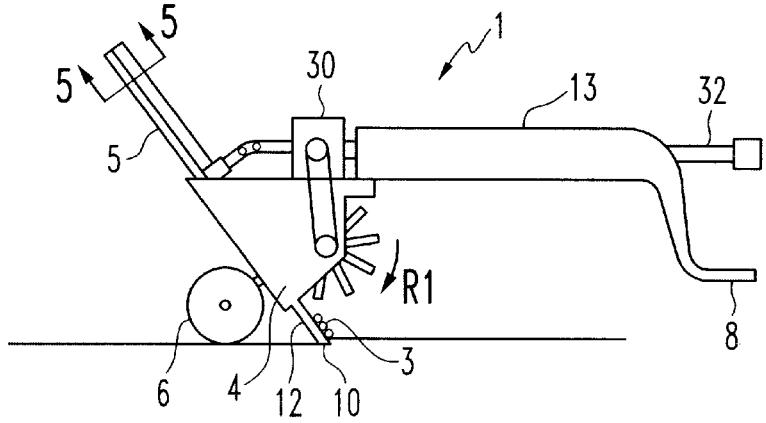
FIG. 3 is a side view of the apparatus of FIG. 1 mounted in a frame and supported by wheels.

FIGS. 1–3 illustrate an apparatus 1 adapted for travel along the ground in an operating travel direction T for cutting a layer of soil 3 and spreading the cut soil 3 over the ground adjacent to the apparatus 1. The apparatus comprises a disc 5 rotatably mounted on a frame 4 of the apparatus 1. In the illustrated embodiment the frame is mounted on wheels 6 and is adapted to be towed by a tractor or the like attached to hitch 8. In alternate embodiment the apparatus could be mounted directly on a powered vehicle or otherwise adapted for movement along the ground.

The disc 5 is mounted such that it has a rotational plane P sloping backward and upward from a lower portion of the frame 4 at an angle N of between 45 and 75 degrees above the horizontal plane. For purposes of description, the disc 5 has a top surface 7 that includes an annular outer portion OP adjacent to the outer edge of the disc 5, and an inner portion IP which comprises the rest of the surface 7 inside the outer portion OP.

Figure 5:
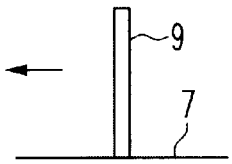
FIGS. 5–5B illustrate various shapes of spreading members.
Figure 5A:
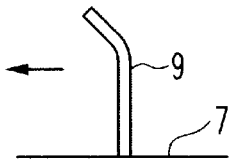
Figure 5B:
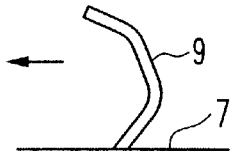

A plurality of spreading members 9 are oriented upright on the top surface 7 of the disc 5 and extend radially from near the center of the disc 5 to near the outer edge thereof. The spreading member 9 can be simply an upright plate as illustrated in FIG. 5. In some soil conditions a cupped spreading member 9 could be advantageous, as illustrated in FIGS. 5A and 5B. Other shapes could be more suitable in other soil conditions, as soil conditions will vary dramatically in texture, moisture content, and so forth.

A blade 10 is mounted on a lower front portion of the frame 4 ahead of and below the outer edge of the disc 5. The illustrated blade 10 has a projecting center portion to better penetrate hard ground. The frame 4 is raised and lowered by linkages and actuators varying the position of the wheels 6 and the attached blade 10 can thus be moved up and down to selectively engage the ground to cut a layer of soil 3. A pan 12 extends from the blade 10 rearward and over the outer portion OP of the top surface 7 of the disc 5 such that soil 3 cut by the blade 10 can flow over the pan 12 and onto the inner portion IP of the top surface 7 of the disc 7.

As best seen in FIG. 2 the rear edge 14 of the pan 12 is shaped in an arc and the center of the arc substantially coincides with the rotational axis of the disc 5 such that the rear edge 14 of the pan 12 covers the outer portion OP of the top surface 7 of the disc 5. In the illustrated embodiment the arc has a radius that is approximately 4 inches less than the radius of the disc 5, and the outer portion OP of the top surface 7 of the disc 5 is approximately 4 inches wide. The soil 3 flowing over the pan 12 is substantially prevented from flowing onto the outer portion OP of the top surface 7 of the disc 5 because the pan 12 overlaps and covers the outer portion OP.

A kicker 20 is rotatably mounted above the blade 10 about a kicker axis transverse to the operating travel direction T. The kicker 20 comprises a kicker shaft 22 and a plurality of kicking members 24 extending radially outward from the kicker shaft 22. The kicking members 24 have soil engaging faces 26 oriented at an oblique angle to the kicker axis such that when the faces 26 contact soil 3 under the kicker 20 the contacted soil 3 is propelled rearward and towards the center of the apparatus 1 when the kicker 20 rotates. The faces 26 are oriented rearward and toward the center line CL of the apparatus 1 when the kicker shaft 22 is rotated such that the faces 26 are extending down from the kicker shaft 22. As best seen in FIG. 2, a plurality of kicking members 24 are arranged in left and right spirals around left and right end portions of the kicker shaft 22 such that they resemble auger flighting with gaps.

Figure 4:
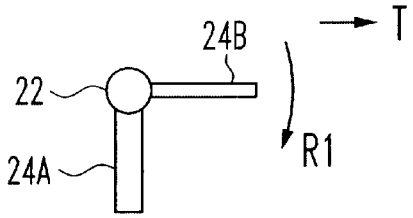
FIG. 4 is a schematic end view of the kicker.
Figure 4A:
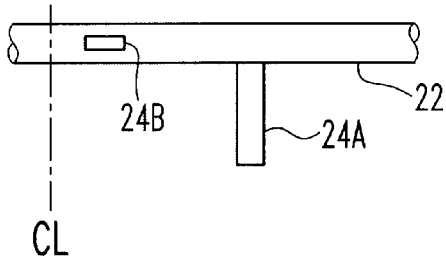
FIG. 4A is a schematic front view of the kicker.
Figure 4B:
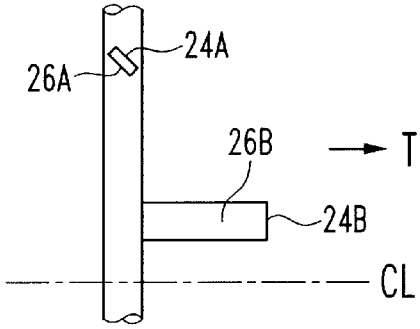
FIG. 4B is a schematic bottom view of the kicker.

To best enable a clear description FIGS. 4–4B are schematic views of the kicker 20 showing only first and second kicking members 24A, 24B. The first kicking member 24A is located at some remove from the center line CL of the apparatus 1 and oriented such that the kicking member 24A and the soil engaging face 26A thereof are extending downward from the kicker shaft 22 in position to engage soil 3 raised by the blade 10. It can be seen in FIG. 4B that the face 26A faces rearward and toward the center of the apparatus 1 and that as the kicker 20 rotates in direction RI the kicking member 24A will propel soil 3 that it contacts rearward and toward the center of the apparatus 1.

The second kicking member 24B with soil engaging face 26B is located in proximity to the center line CL of the apparatus 1. The face 26B is oriented substantially radially from, and parallel to, the kicker axis such that soil 3 contacted thereby is propelled directly rearward when the kicker 20 rotates.

The kicking members 24 that are oriented in the spirals are oriented with faces 26A on an angle similar to FIG. 4. The kicking members 24B near the center are oriented with faces 26B parallel to the kicker axis. Thus the kicking members 24A propel soil rearwards and to the center, either to the left or right as required, while the centrally located kicking members 24B propel soil 3 directly rearward. The faces 26 have been illustrated as being flat but could be curved somewhat if desired and still perform the required function. The faces 26B on the central kicking members 24B especially could be cupped.

The kicker 20 can be rotated at considerable speed so that soil 3 is propelled well back onto the inner portion IP of the top surface 7 of the disc 5. In combination with the pan 12 which prevents soil 3 from falling on the edge of the disc .5, the majority of the soil 3 winds up landing on the inner portion IP reducing power requirements and improving the spread pattern.

Figure 6:
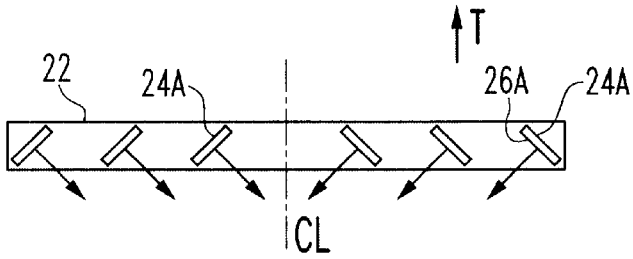
FIG. 6 is a schematic bottom view of an alternate arrangement of the kicking members.

FIG. 6 illustrates an alternative kicker wherein the kicking members 24A are all oriented on an angle such that the faces 26A face the center rear of the apparatus as indicated by the arrows. The kicking members 24A are aligned along the shaft 22, rather than in a spiral. The kicking members 24A at the center essentially push the soil towards each other and back, creating a rearward flow of soil.

Figure 7:
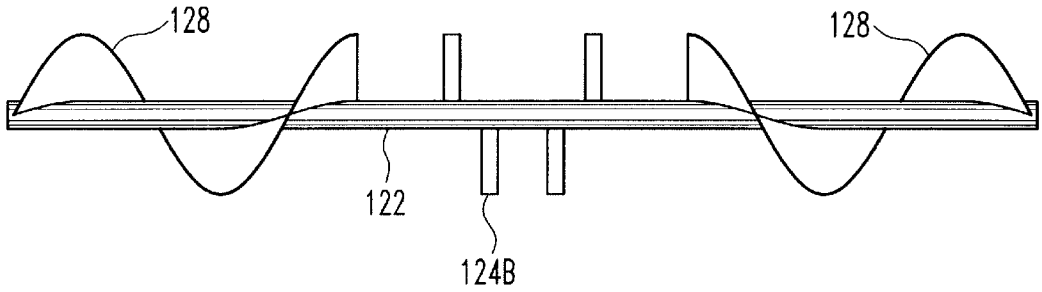
FIG. 7 is front view of an alternate kicker comprising auger flightings.

FIG. 7 illustrates an alternative kicker 120 comprising a kicker shaft 122 with an auger flighting 128 attached on opposite end portions of the kicker shaft 120. Each auger flighting 128 is oriented to move soil in contact therewith toward the middle of the kicker shaft 120 when the kicker 120 rotates. Kicking members 124 extend radially from a central portion of the shaft 122 to throw the soil rearward. The spiral arrangement of the kicking members 24A in FIG. 2 also approximates an auger flighting with sections cut out of the flighting from the edge to the shaft 22. In the embodiment of FIG. 2 soil does not build up as quickly on the faces as it does on the auger flighting 128. It appears that soil 3 passes between the kicking members 24 and reduces soil build up.

In each embodiment the kickers are operative to propel soil 3 cut by the blade 10 in a direction rearward and toward a center of the apparatus 1. Moving the soil 3 straight back from the blade 10, as in prior art beaters, results in a long travel distance for the soil 3 at the outer ends of the blade 10. Moving the soil 3 toward the center results in a shorter travel distance for soil near the ends. A good deal of soil 3 from the ends, especially with the auger flighting or spiral embodiments, will work to the middle of the kicker where the middle kicking members can propel it back along the shortest path to the inner portion of the disc.

A drive 30 is operative to rotate the disc 5 in direction R2 and the kicker 20 in direction R1. The embodiment of FIG. 3 shows a drive shaft 32 adapted for attachment to a tractor, however other drives could serve the purpose as well. The illustrated drive shaft 32 passes through a hitch tube 13

Figure 8:
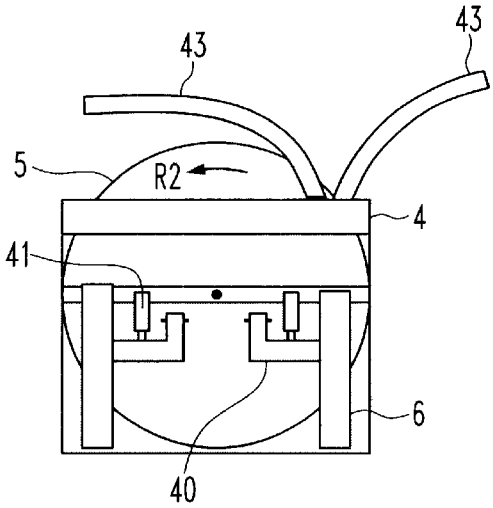
FIG. 8 is a schematic rear view of an apparatus including actuators to adjust blade slope, and soil directing members.

FIG. 8 illustrates a tilt mechanism 40 operative to tilt the apparatus 1 up or down on one side compared to the opposite side for controlling the slope of the blade 10 from one side to the other. The tilt mechanism 40 comprises actuator 41 operative to move the wheels 6 up and down independently of each other. A single actuator 41 could also be used moving only one of the wheels 6 up and down while the other wheel 6 remained stationary.

FIG. 8 also illustrates left and right soil directing members 43. These can be moved up to essentially allow soil exiting the disc to flow with little direction, or selectively lowered to direct the soil.

Figure 9:
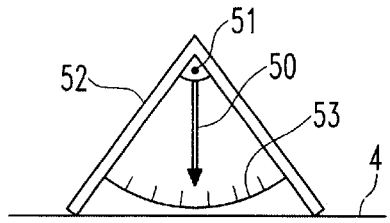
FIG. 9 is a front view of a pendulum to indicate the slope of the blade from side to side.

FIG. 9 illustrates a pendulum 50 that pivots from side to side on pivot pin 51 supported by pendulum frame 52 fixed to the frame 4. The slope from one side to the other of the frame 4, and thus the blade 10, is indicated on the scale 53 and is visible to the operator. The pendulum is mounted on the apparatus so as to be visible by the operator. Actuators 41 allow the operator to attain and maintain the desired slope of the blade 10.

The foregoing is considered as illustrative only of the principles of the invention. Further, since numerous changes and modifications will readily occur to those skilled in the art, it is not desired to limit the invention to the exact construction and operation shown and described, and accordingly, all such suitable changes or modifications in structure or operation which may be resorted to are intended to fall within the scope of the claimed invention.

We claim:

1. An apparatus adapted for travel along the ground in an operating travel direction for cutting a layer of soil and spreading the cut soil over the ground adjacent to the apparatus, the apparatus comprising:

a disc rotatably mounted on the apparatus, the disc having a rotational plane sloping backward and upward from a lower portion of the apparatus at an angle between 45 and 75 degrees above a horizontal plane, the disc having a top surface that includes an annular outer portion adjacent to an outer edge of the disc, and an inner portion;

a plurality of spreading members oriented upright on the top surface of the disc;

a blade mounted on a lower front portion of the apparatus ahead of and below the outer edge of the disc and operative to cut a layer of soil;

a pan extending from the blade rearward and over the outer portion of the top surface of the disc such that soil cut by the blade can flow over the pan and onto the inner portion of the top surface of the disc, but is substantially prevented from flowing onto the outer portion of the top surface of the disc;

a kicker rotatably mounted above the blade about a kicker axis transverse to the operating travel direction, the kicker operative to propel soil cut by the blade in a direction rearward and toward a center of the apparatus; and a drive operative to rotate the disc and the kicker.

2. The apparatus of claim 1 wherein a rear edge of the pan is shaped in an arc and wherein a center of the arc substantially coincides with a rotational axis of the disc.

3. The apparatus of claim 2 wherein the arc has a radius at least three inches less than a radius of the disc.

4. The apparatus of claim 1 wherein the outer portion of the top surface of the disc is between 3 and 6 inches wide.

5. The apparatus of claim 1 wherein the kicker comprises a kicker shaft and a plurality of kicking members extending outward from the kicker shaft.

6. The apparatus of claim 5 wherein a plurality of the kicking members comprise soil engaging faces oriented at an oblique angle to the kicker axis such that when the faces contact soil under the kicker the contacted soil is propelled rearward and towards the center of the apparatus when the kicker rotates.

7. The apparatus of claim 6 wherein a plurality of faces are oriented rear ward and toward the center of the apparatus when the kicking shaft is rotated such that the faces are extending downward from the kicker shaft.

8. The apparatus of claim 6 wherein at least one face located in proximity to a middle of the kicker shaft is oriented substantially radially from, and parallel to, the kicker axis such that soil contacted thereby is propelled directly rearward when the kicker rotates.

9. The apparatus of claim 6 wherein a plurality of kicking members are arranged in a spiral around the kicker shaft.

10. The apparatus of claim 1 wherein the kicker comprises a kicker shaft with an auger flighting attached on opposite end portions of the kicker shaft, each auger flighting oriented to move soil in contact therewith toward the middle of the kicker shaft when the kicker rotates.

11. The apparatus of claim 10 further comprising a plurality of kicking members extending upright from a central portion of the kicker shaft between the auger flightings, the kicking members oriented such that when the kicking members contact soil under the kicker the soil contacted is propelled rearward when the kicker rotates.

12. The apparatus of claim 11 wherein at least one kicking member comprises a face oriented substantially radially from, and parallel to, the kicker axis such that soil contacted thereby is propelled directly rearward when the kicker rotates.

13. The apparatus of claim 1 further comprising a tilt mechanism operative to tilt the apparatus up or down on one side compared to the opposite side.

14. The apparatus of claim 13 wherein the apparatus is mounted on wheels and wherein the tilt mechanism comprises an actuator operative to move at least one wheel up and down independently of other wheels.

15. The apparatus of claim 13 further comprising a pendulum device operative to indicate a degree of tilt to an operator of the apparatus.

16. The apparatus of claim 1 further comprising at least one soil directing member arranged to direct soil leaving the disc.

17. An apparatus for cutting a layer of soil and spreading the cut soil over the ground adjacent to the apparatus, the apparatus comprising:

a frame adapted for travel along the ground in an operating travel direction;

a blade mounted on a lower front portion of the frame and operative to cut a layer of soil;

a disc rotatably mounted on the frame behind the blade, the disc having a rotational plane sloping backward and upward from a lower portion of the frame at an angle between 45 and 75 degrees above a horizontal plane;

a plurality of spreading members oriented upright on a top surface of the disc;

a pan mounted on the frame and extending from the blade rearward to a location above the top surface of the disc removed from an outer edge of the disc such that soil cut by the blade can flow over the pan and onto the top surface of the disc, but is substantially prevented from falling onto an outer portion of the top surface of the disc that is in proximity to an outer edge of the disc;

a kicker rotatably mounted on the frame above the blade about a kicker axis transverse to the operating travel direction, the kicker operative to propel soil cut by the blade in a direction rearward and toward a center of the apparatus; and a drive operative to rotate the disc and the kicker.

18. The apparatus of claim 17 wherein a rear edge of the pan is shaped in an arc and wherein a center of the arc substantially coincides with a rotational axis of the disc.

19. The apparatus of claim 17 wherein the kicker comprises a kicker shaft and a plurality of kicking members extending substantially radially from the kicker shaft.

20. The apparatus of claim 19 wherein a plurality of the kicking members comprise soil engaging faces oriented at an oblique angle to the kicker axis such that when the faces contact soil under the kicker the contacted soil is propelled rearward and towards the center of the apparatus when the kicker rotates.

21. The apparatus of claim 17 wherein the kicker comprises a kicker shaft with an auger flighting attached on opposite end portions of the kicker shaft, each auger flighting oriented to move soil in contact therewith toward the middle of the kicker shaft when the kicker rotates and a plurality of kicking members extending upright from a central portion of the kicker shaft between the auger flightings, the kicking members oriented such that when the kicking members contact soil under the kicker the soil contacted is propelled rearward when the kicker rotates.

22. The apparatus of claim 17 further comprising a tilt mechanism operative to tilt the apparatus up or down on one side compared to the opposite side.

23. The apparatus of claim 22 wherein the apparatus is mounted on wheels and wherein the tilt mechanism comprises an actuator operative to move at least one wheel up and down independently of other wheels.

24. The apparatus of claim 22 further comprising a pendulum device operative to indicate a degree of tilt to an operator of the apparatus.

25. The apparatus of claim 17 further comprising at least one soil directing member arranged to direct soil leaving the disc.

* * * * *